US005683306A

United States Patent [19]

Tait et al.

[11] Patent Number: 5,683,306

[45] Date of Patent: Nov. 4, 1997

[54] INCLINING GOLF PRACTICE PLATFORM PIVOTABLE BY USER'S WEIGHT

[75] Inventors: D. Logan Tait; L. Bruce Tait; Gordon A. Tait; Dean N. Spriddle; Timothy G. Elhatton, all of Lethbridge; Denis P. Heidenreich, Calgary, all of Canada

[73] Assignee: 680104 Alberta Ltd., Lethbridge, Canada

[21] Appl. No.: 663,690

[22] Filed: Jun. 14, 1996

Related U.S. Application Data

[63] Continuation-in-part of Ser. No. 170,957, Dec. 21, 1993, Pat. No. 5,527,042.

[51] Int. Cl.[6] ..... A63B 69/36

[52] U.S. Cl. ..... 473/279

[58] Field of Search ..... 473/279

[56] References Cited

U.S. PATENT DOCUMENTS

| | | | |
|---|---|---|---|
| 2,591,051 | 4/1952 | Caldwell | 248/188.5 X |
| 2,879,996 | 3/1959 | Lederer | 473/279 |
| 2,908,472 | 10/1959 | McDonald | 248/649 X |
| 2,956,761 | 10/1960 | Weber | 248/188.3 X |
| 3,281,101 | 10/1966 | May | 248/188.3 X |
| 3,516,513 | 6/1970 | Robertson | 248/188.3 X |
| 3,633,917 | 1/1972 | Anderson | 473/279 |
| 3,633,918 | 1/1972 | Smiley et al. | 473/279 |
| 3,869,127 | 3/1975 | Kohori | 473/279 |
| 4,613,133 | 9/1986 | Selberg et al. | 473/279 |
| 4,875,684 | 10/1989 | Benilan | 473/279 |
| 5,005,837 | 4/1991 | Martinez | 473/279 |
| 5,114,327 | 5/1992 | Williamson | 425/139 |
| 5,183,449 | 2/1993 | Decloux | 482/53 |
| 5,340,111 | 8/1994 | Froelich | 473/279 |
| 5,527,042 | 6/1996 | Spriddle | 473/279 |

*Primary Examiner*—William H. Grieb
*Attorney, Agent, or Firm*—Bennett Jones Verchere

[57] ABSTRACT

A practice platform is provided for use by a golfer to practice swinging a club on different inclines. The practice platform has a deck pivotally mounted to a base. Unlike known prior practice golf platforms, the deck is intended to be pivoted to different inclines solely by the golfer's positioning himself upon the deck so that his weight causes the deck to pivot, without the use of a power drive mechanism. The platform includes a mechanism to hold the deck in the selected position, and also to facilitate positioning of the deck by restricting it from pivoting freely through its full range of motion in reaction to the golfer's weight. A valve is provided which can control simultaneously the pivoting of the deck in all directions.

8 Claims, 6 Drawing Sheets

INCLINING GOLF PRACTICE PLATFORM PIVOTABLE BY USER'S WEIGHT

This application is a continuation-in-part of U.S. application Ser. No. 08/170,957, filed Dec. 21, 1993, now U.S. Pat. No. 5,527,042.

FIELD OF THE INVENTION

This invention relates to devices of the type used to assist golfers in practicing their golf swing. In particular, the invention relates to a platform having a deck whose angle of inclination may be altered in order for a golfer to practice his swing in uphill, downhill or sidehill ball placement situations.

BACKGROUND OF THE INVENTION

Since the game of golf is played on an uneven playing field, it is common for golfers to be presented with a ball position on sloping terrain. Under the rules of golf, the ball must be hit from where it lies. Accordingly, being able to hit a ball cleanly and accurately from an inclined or uneven position is an important skill necessary in order to excel at the game.

To increase their skill at hitting a golf ball, golfers often practice their swing by hitting balls at a practice or driving range. Since hitting a golf ball accurately from an inclined slope is generally considered one of the more difficult golf shots, many golfers also wish to practice their swing on inclined surfaces. Unfortunately, most commercial facilities which provide golfers with areas to practice provide only level or flat practice surfaces.

Various attempts have been made to provide practice platforms that simulate uneven or inclined terrain. Numerous such devices having a base and an inclined deck have been developed for this purpose. Although the known devices take various shapes and forms, they all essentially comprise an inclined deck providing a surface upon which a golfer may practice his swing with some form of power drive means, connected to an external source of power, used to position and reposition the platform in different attitudes and thereby enable a golfer to practice his swing on varying degrees and orientations of inclination.

The inherent problems or limitations of the known inclining practice platforms revolves around their use of power drive means and external power sources. Because they utilize such drive means and power sources, their internal mechanisms tend to include complex mechanical and electrical components. As a result they suffer from the disadvantages of high cost, susceptibility to breakdown, high maintenance, and a need for a readily available external power source. Where such devices are used in an outdoor environment, moreover, their electrical components must be shielded from exposure to water and moisture, and they are also susceptible to corrosion and malfunction. Furthermore, many of these prior devices lack a means to lock the platform in position, or where such a locking mechanism is present it is dependent upon the external power source for its functioning.

SUMMARY OF THE INVENTION

Accordingly, the present invention provides a practice platform for use by a golfer to practice swinging a club on different inclines, comprising a base, a deck pivotally mounted to the base and pivotable to different inclines solely by a golfer positioning himself thereupon so that his weight causes the deck to pivot, without the use of power drive means, and releasable holding means to prevent the deck from pivoting further once it has been pivoted to a selected incline regardless of the subsequent repositioning of the golfer upon the deck.

Preferably, the practice platform further comprises means to moderate the speed at which the deck is pivotable on the base in reaction to the golfer's weight.

Advantageously, the practice platform includes at least one fluid activated cylinder connected from the base to the deck and having a fluid line extending therefrom and also valve means to control the flow of fluid through the cylinder, the valve means having an open position permitting operation of the cylinder and thereby permitting pivotal movement of the deck relative to the base in reaction to the golfer's weight, and having a closed position preventing operation of the cylinder and thereby preventing pivotal movement of the deck relative to the base. More advantageously, the cylinder has two fluid containing chambers separated by a piston and has two fluid lines, one connecting to each chamber, and the fluid lines connect to each other in a closed loop.

Most preferably, the deck is mounted to the base by means of a universal joint allowing multi-directional pivoting of the deck relative to the base, and the practice platform includes a plurality of fluid activated cylinders, for controlling pivoting of the deck on the base in generally orthogonal directions of inclination. For example, two fluid actuated cylinders or, to improve the stability of the platform, four cylinders can be used.

In a preferred embodiment a multiple circuit valve is used which can simultaneously control a plurality of cylinders. In one embodiment, the fluid activated cylinders each have at least one hydraulic chamber and the valve means provides a circuit between each of at least two pairs of the hydraulic chambers. Preferably, the valve has ports for accepting the fluid lines from the cylinders and a means for controlling simultaneously communication between the ports. The use of such a valve simplifies operation of the platform and enhances smooth inclining of the deck.

It has surprisingly been found that while hitherto known inclining practice platforms all include some form of power drive means, utilization of the golfer's own weight can achieve the same result without the complexity and cost of power drive means.

Other objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show a preferred embodiment of the present invention in which.

DESCRIPTION OF THE PREFERRED EMBODIMENT

Figure 1:
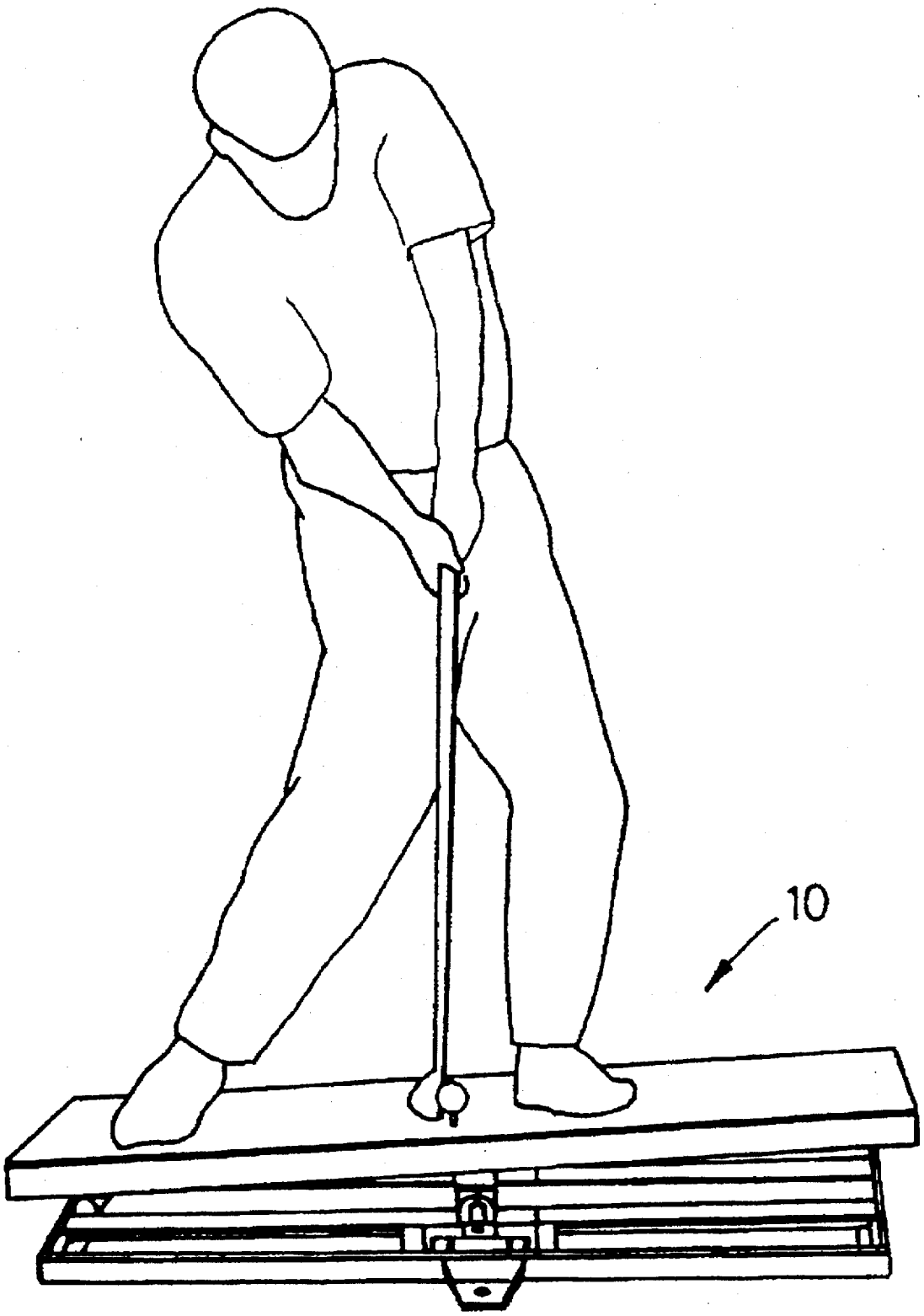
FIG. 1 is a side perspective view from above of a practice platform of the present invention, showing a typical positioning of a golfer upon it.
Figure 2:
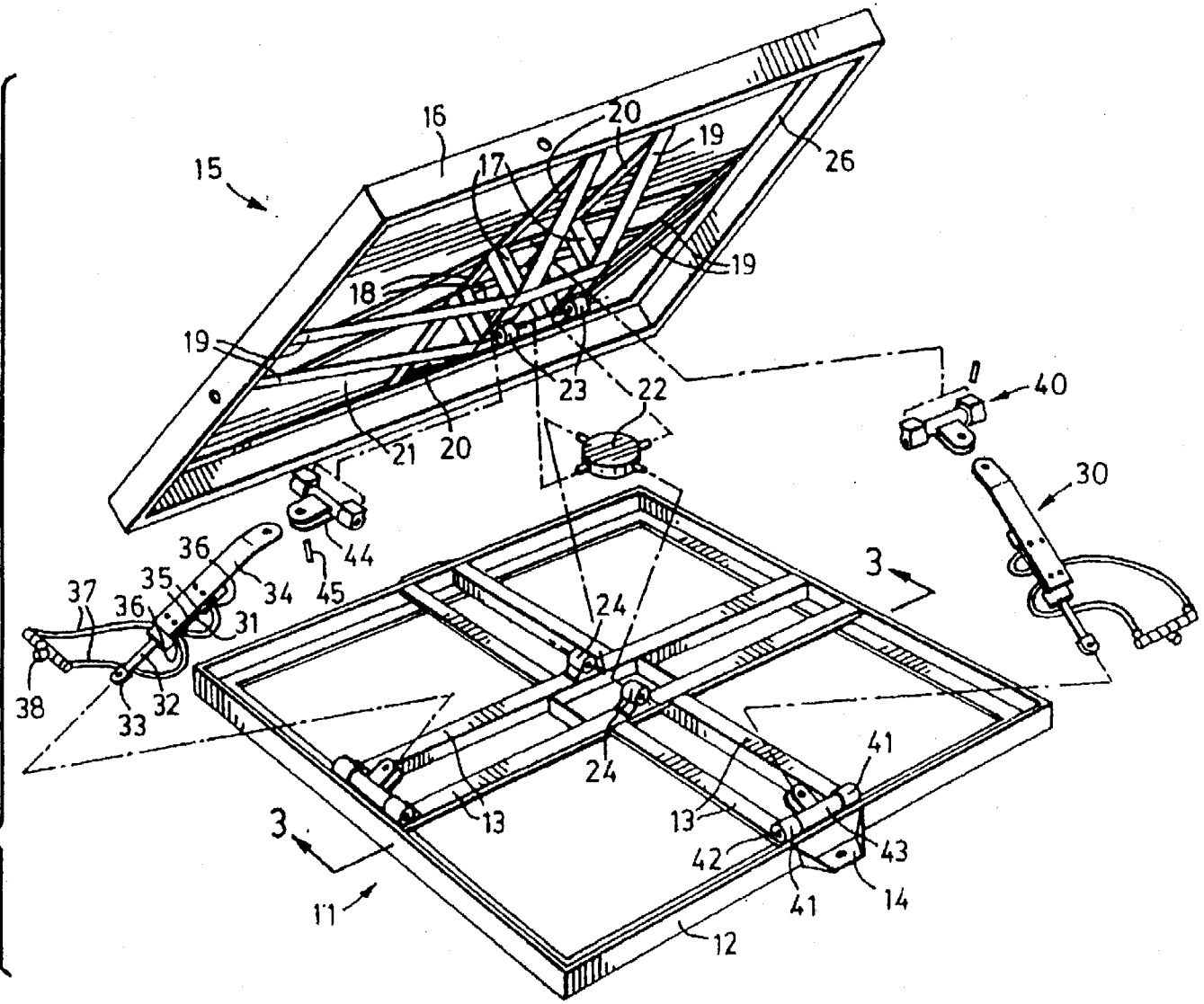
FIG. 2 is an exploded oblique perspective view of the practice platform of FIG. 1.
Figure 5:
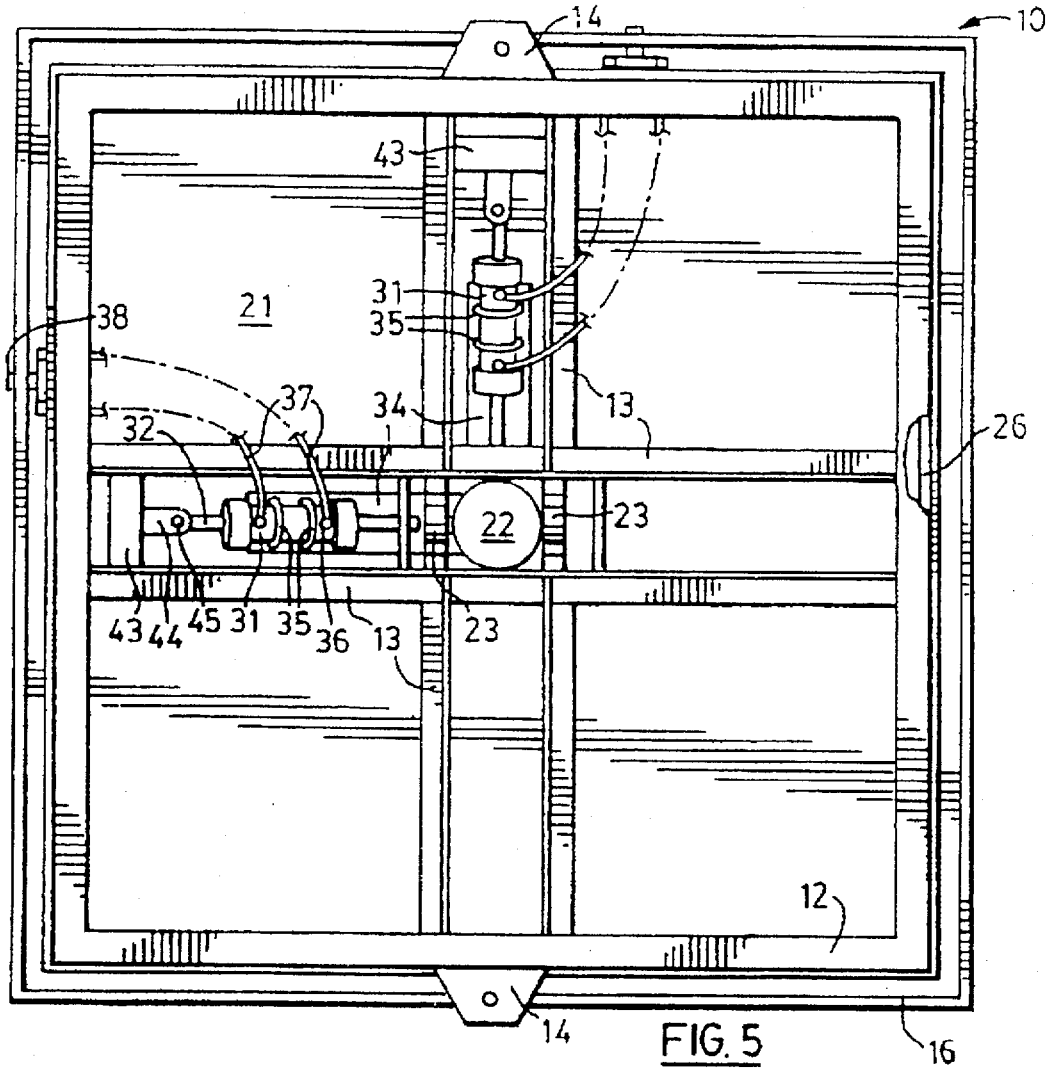
FIG. 5 is a bottom view of the practice platform FIG. 3 in the direction shown by the arrows of line 5—5, omitting the deck's supporting truss network for understanding.
Figure 3:
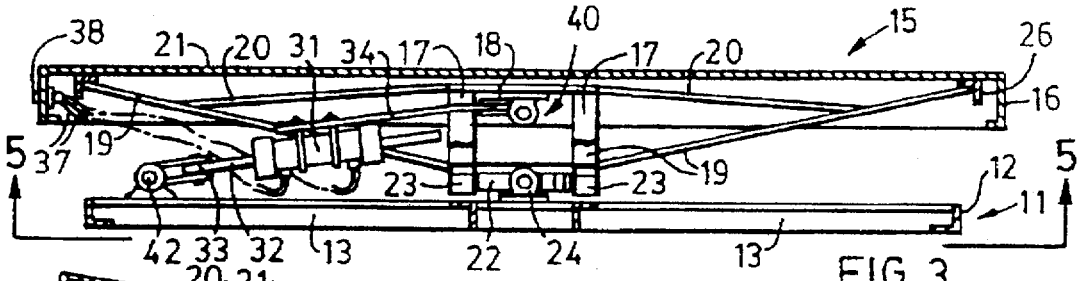
FIG. 3 is a cross-sectional elevation view of the practice platform of FIG. 2 taken along the line 3—3 in the direction of the arrows, with the deck in a horizontal position.
Figure 4:
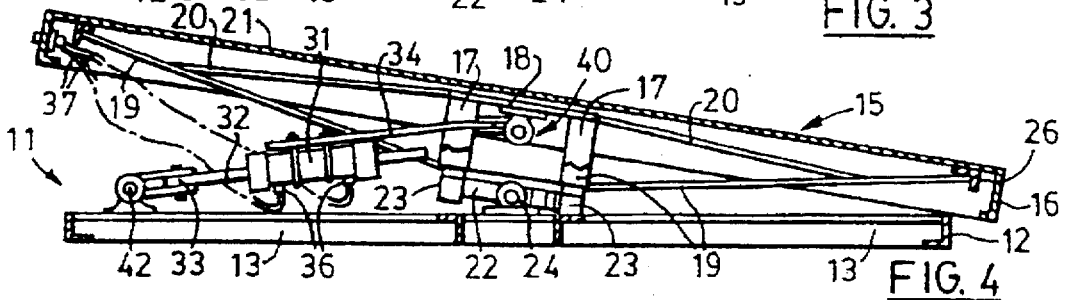
FIG. 4 is the same cross-sectional elevation view of the practice platform of FIG. 3, with the deck re-oriented in an inclined position.

Referring first to FIG. 1, the practice platform, designated generally by reference numeral 10, is intended to be placed upon the ground so that a golfer can place himself upon it to practice his golf swing, as shown.

Turning to FIGS. 2–5, the practice platform 10 comprises a base 11 and a deck 15 which is mounted to the base 11 by means of a universal joint assembly and a pair of hydraulic cylinders 30. The base comprises a base frame 12 and cross members 13 which extend across the sides of the frame 12. A pair of lugs 14 extend outwardly from two opposite sides of the base frame 12 and provide means for securing the base 11 to the ground.

The deck 15 comprises an upper portion and a supporting truss network. The upper portion includes sides 16 and floor 21. The truss network comprises four parallel spaced posts 17 held together at their tops and bottoms with braces 18 to form a box-like structure. Eight struts 19 extend from the bottom of the posts 14 to a deck frame 26 that runs along the bottom of the floor 21 close to the sides 16. Ties 20 extend from the tops of the posts 17 to connect with the struts 19.

The deck 15 is mounted to the base 11 by means of a universal joint assembly comprising a plate 22 from which extend four pivot pins 25 radiating outwardly and aligned in two orthogonal pairs. One pair of pivot pins 25 is journaled in a pair of bushings 24 mounted to two cross members 13 of the base 11. The other pair of pivot pins 25 is journaled within another pair of bushings 23 mounted on two braces 18 of the deck 15, the second pair of bushings 23 being oriented in a plane that is generally orthogonal to the first set of bushings 24.

This universal joint assembly provides for independent pivoting of the pivot pins 25 within the first set of bushings 24 and the pivot pins 25 within the second set of bushings 23, thereby permitting the deck 15 to be inclined in any direction relative to the base 11.

A pair of hydraulic cylinders 30 extend between the base 11 and the deck 15 held by upper and lower cylinder connectors 40, which are mounted to two orthogonal braces 18 and corresponding orthogonal side members of the frame 12, respectively.

Each of the hydraulic cylinders 30 comprises a housing 31 and a piston rod 32 which extends slidingly through hydraulically sealed orifices at either end of the housing 31 and which comprises a piston extending across the interior of the housing that divides the housing into upper and lower chambers, whose sizes vary with the position of the piston rod.

The lower end of the piston rod 32 merges to a blade 33. A bar 34 is secured to the housing 31 by means of U-bolts 35 and extends upwardly beyond the housing 31 and beyond the upper end of the piston rod 32.

Upper and lower hose lines 37 connect to upper and lower ports 36, respectively, and thereby communicate with the upper and lower chambers within the housing. The upper and lower hose lines 37 also connect to a valve 38, and thereby establish a closed loop.

When the valve 38 is in its closed position, hydraulic fluid within the closed loop cannot flow, and therefore the piston rod 32 resists any displacement within the housing 31. When the valve 38 is in its open position, hydraulic fluid within the closed loop can flow, and therefore the piston rod 32 can slide within the housing 31.

Each of the upper and lower cylinder connectors 40 comprises a pair of rings 41 holding a shaft 42 upon which is pivotally secured a sleeve 43. A pair of leaves 44 extend outwardly from the sleeve 43. The leaves 44 of the upper connector 40 receive between them, the upper end of the extension bar 34 which is pivotally connected thereto by means of a pin 45 that extends through aligned holes in the extension bar 34 and the leaves 44. The leaves 44 of the lower connector 40 receive between them the blade 33 which is pivotally connected thereto by means of another pin 45 that extends through aligned holes in the blade 33 and the leaves 44. The upper and lower connectors 40 thereby permit the hydraulic cylinders 30 to hinge upwardly and downwardly and also to pivot laterally from side to side.

The sides of the base frame 12 and the cross members 13 are made of steel angle, and are welded together. The posts 17 and deck frame 26 members are made of steel angle, and the braces 18, struts 19, and ties 20 are all made of steel flat bar, welded to each other and the posts 17 and the deck frame 26. The floor 21 and sides 16 are made of light gauge aluminium plate. The floor 21 is braised and bolted to the deck frame 26. A cover of synthetic turf material is applied adhesively to the top of the floor 21.

In use, a golfer steps onto the floor of the deck portion of the platform. If the golfer wants to change the angle or orientation of the incline of the deck, he positions himself on that part of the floor that he wants to move downwardly. He then opens the valves, which are normally biased to a closed position. When the valves are opened, hydraulic fluid is permitted to flow through the closed loops and the deck moves under the weight of the golfer.

The speed at which the deck moves is limited by the flow of the hydraulic fluid. Thus, the sizes of the cylinder housing, and of the hoses and the valves, are selected to prevent the deck from moving so fast that maneuvering it would be difficult or so fast that a significant shock would be encountered by the golfer when movement of the deck ceased. The sizes of the cylinder housing, hoses and valves are also selected through to permit the deck to move quickly enough so as not to cause undue delay in changing the inclination of the deck.

When the deck has been moved to the desired new inclination, the golfer closes the valves to prevent further flow of hydraulic fluid in the closed loops. The deck thus stops moving any further, and it remains in the selected inclination regardless of where the golfer subsequently repositions himself.

Figure 6:
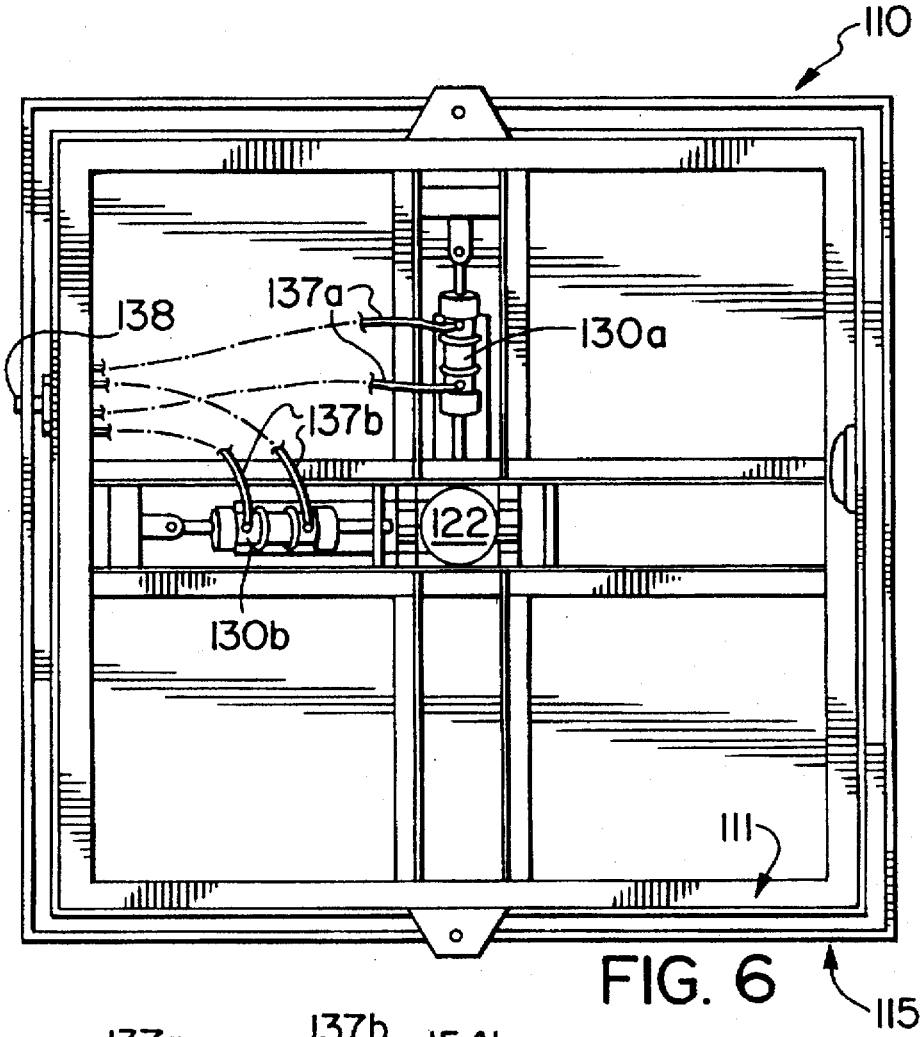
FIG. 6 is a bottom view of another practice platform of the present invention, omitting the deck's supporting truss network for understanding.
Figure 7:
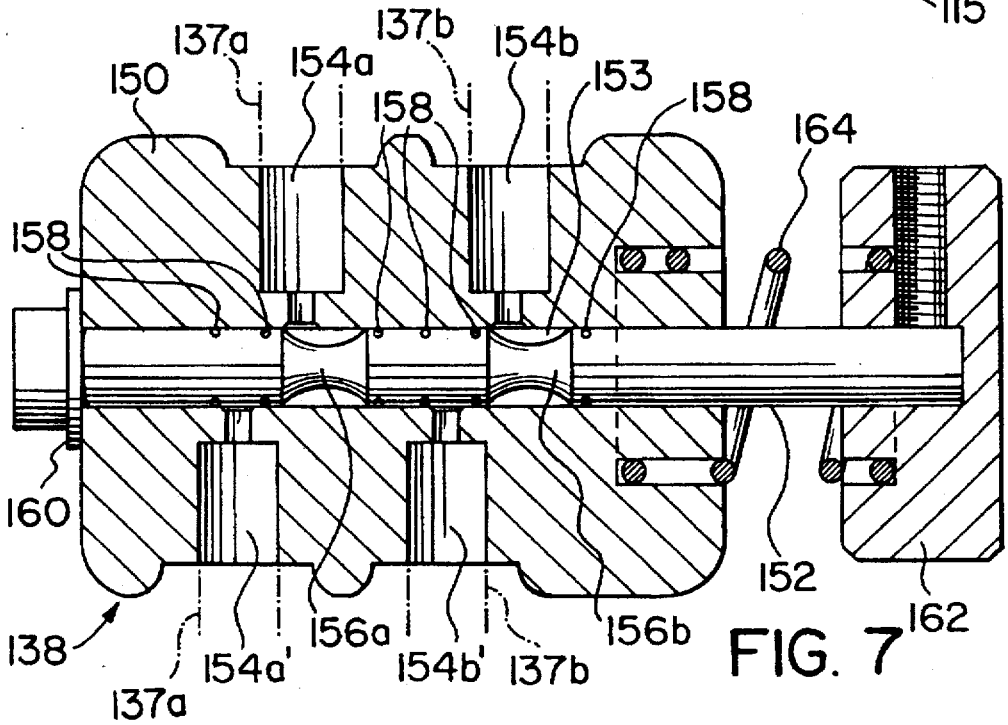
FIG. 7 is a sectional view through a valve useful in the present invention.

Referring to FIGS. 6 and 7, an alternate embodiment of the practice platform 110 is shown, having a valve 138 which controls actuation of a plurality of cylinders simultaneously. Such an embodiment simplifies actuation of the hydraulic cylinders over the embodiment shown hereinbefore and allows smoother operation to change the angle or orientation of the incline of the deck. The practice platform comprises a base 111 and a deck 115 attached by means of a universal joint assembly 122 and a pair of hydraulic cylinders 130*a*, 130*b* as described hereinbefore, except that upper and lower hose lines 137*a*, 137*b* of both cylinders 130*a*, 130*b* connect to the valve. The valve can be positioned at the side of the deck surface, as shown, or on the top surface thereof.

The valve 138 includes a housing 150 and a rod 152 extending slidingly through a bore 153 formed in housing 150. Ports 154*a*, 154*a*', 154*b*, 154*b*' extend through housing 150 and open into bore 153. Ports 154*a*, 154*a*' form a pair and accept the upper and lower hoses 137*a* (shown in phantom in FIG. 7) of cylinder 130*a*, while ports 154*b*, 154*b*' also form a pair and accept the lines 137*b* from cylinder 130*b*. Ports 154*a*, 154*a*' are offset a selected distance from each other along the length of the housing, as are ports 154*b*, 154*b*'.

Rod 152 has an enlarged portion 160 at its inner end which limits the range of movement of rod 152 through bore 153. A button 162 is mounted at the outer end of rod 152. A compression spring 164 acts between housing 150 and button 162. Spring 164 normally biases rod such that portion 160 abuts against housing 150. By applying force against button 162 toward housing, spring 164 can be compressed and rod 152 can be moved through bore 153.

Rod 152 has a pair of spaced annular grooves 156*a*, 156*b*. The grooves act to form a cavity between rod 152 and bore 153. Grooves 156*a*, 156*b* are positioned to correspond to the openings of the pairs of ports into the bore, such that each pair of ports has an associated groove. The width of each groove is selected to span the offset distance between its pair of ports. By moving the rod within the bore, each groove can be positioned at both of the openings of its pair of ports or only one of the openings. When the grooves are positioned to span the openings of the ports, a first continuous circuit is set up between corresponding ports 154*a*, 154*a*' through groove 156*a* and a second continuous circuit is set up between ports 154*b*, 154*b*' through groove 156*b*.

The rod is formed at areas 158 to closely conform to the inner diameter of the bore to provide hydraulic seals between adjacent circuits, between offset ports and to prevent leakage of fluid to the outside of the housing. It is to be understood that the hydraulic seals can be formed in other ways such as, for example, by use of O-rings. The rod and housing can be formed of any suitable materials. However, preferably the housing is formed of a softer material than the rod to enhance the wear characteristics of the valve.

Figure 8A:
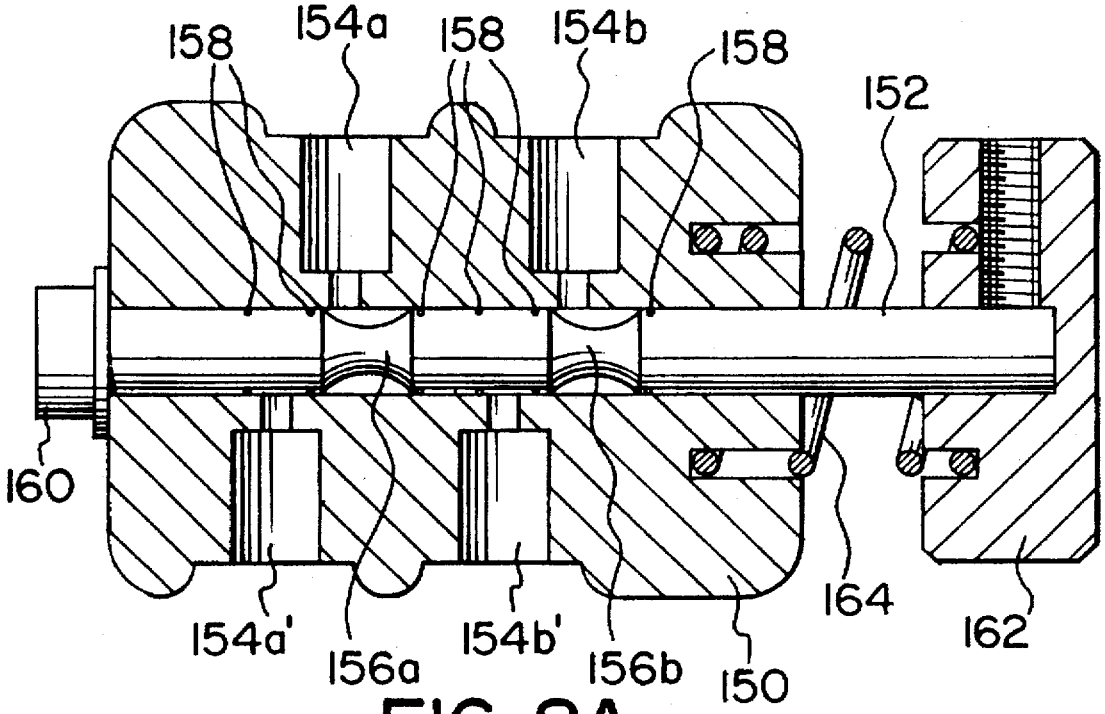
FIGS. 8*a* and 8*b* are schematic views of the valve of FIG. 7 in the closed and open positions, respectively; and, FIG. 9 is a perspective view of another practise platform of the present invention, with the deck and its supporting truss shown in phantom.

When the valve 138 is in its closed position, as shown in FIG. 8*a*, rod 152 is biased outwardly such that portion 160 abuts against housing 150 and grooves 156*a* and 156*b* are aligned only with ports 154*a* and 154*b*, respectively. Rod 152 fits closely within bore 153 and flow of hydraulic fluid is prevented between ports 154*a* and 154*a*', between ports 154*b* and 154*b*' and between ports 154*a* and 154*b*'.

Figure 8B:
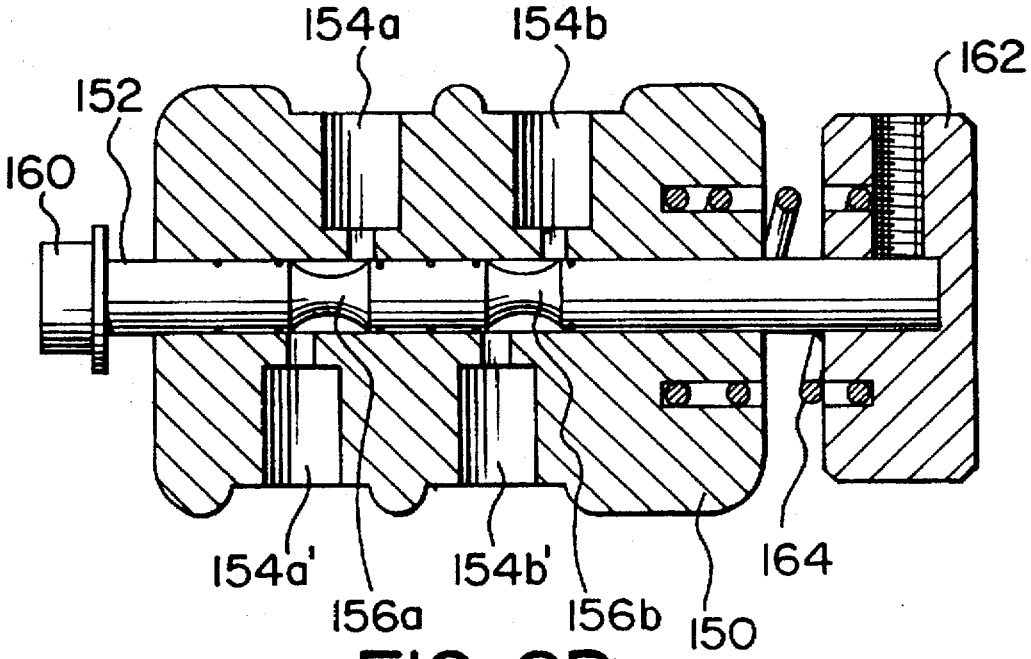

To open valve, to allow the flow of hydraulic fluid between the paired ports, force is applied against button 162 which causes spring 164 to be compressed and rod 152 to slide within bore 153 until grooves 156*a* and 156*b* span the openings of both pairs of ports, as shown in FIG. 8*b*. This causes an open circuit to be set up simultaneously between the ports 154*a* and 154*a*' and between 154*b* and 154*b*' so that hydraulic fluid can flow therethrough. This allows the pistons within the hydraulic cylinders of the practice platform to move to permit inclination of the deck in response to the weight of the golfer on the deck.

Figure 9:
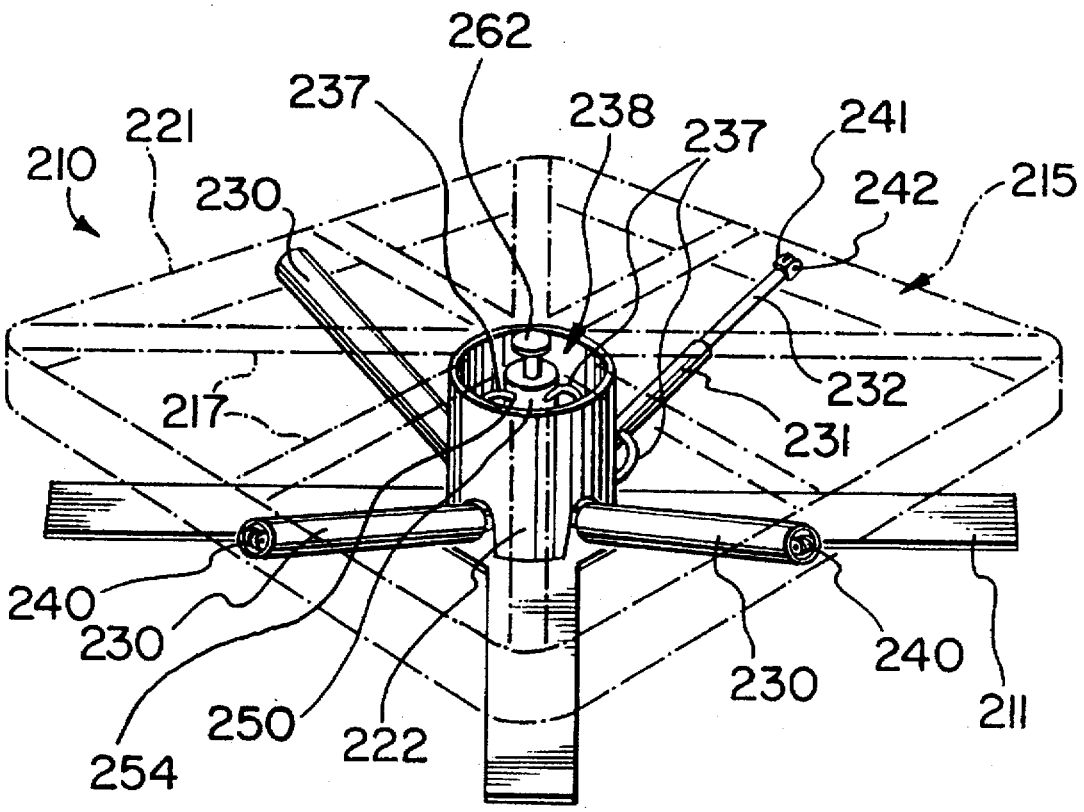

Referring to FIG. 9, another embodiment of the practice platform is shown. The practice platform 210 comprises a base 211 and a deck 215, shown in phantom. The deck 215 comprises an upper portion 221 and a supporting truss network 217 and is mounted to the base by means of a universal joint assembly, generally indicated at 222 and shown covered by a protective sleeve, and four hydraulic cylinders 230, three of which are shown covered by protective sleeves.

The universal joint assembly can be any arrangement, such as for example that described above with respect to FIGS. 2 to 5, which permits the deck 215 to be inclined in any direction relative to the base 211.

The hydraulic cylinders 230 are mounted between the base 211 and the deck 215 held by upper and lower cylinder connectors 240. The upper and lower cylinder connectors 240 can be any arrangement that allows the cylinders to pivot upwardly and downwardly about the connection. For example, as shown, the ends of each cylinder are formed as clevises 241 which are secured by means of pins 242 through apertures formed on the truss members.

Each of the hydraulic cylinders 230 comprises a housing 231 and a piston rod 232 which extends slidingly through a hydraulically sealed orifice at one end of the housing 231 and which comprises a piston extending across the interior of the housing that defines a single hydraulic fluid-filled chamber. The cylinders on opposing sides of the mounting assembly act as a pair to provide releasable holding of the deck in either direction. Hose lines 237 connect between the single chamber of each of the paired cylinders and ports 254 on a valve 238, and thereby establish a closed loop between the paired cylinders. Opening of the valve permits flow of hydraulic fluid from the cylinder on one side to the cylinder on the other side.

Valve 238 has a button 262 which extends through a centrally located hole on the top surface of the deck. The housing 250 of the valve 238 is mounted below the deck. Valve 238 is a multiple circuit valve and acts to control simultaneously the four cylinders.

When the valve 238 is in its closed position, hydraulic fluid within the closed loop cannot flow, and therefore the piston rods 232 cannot be displaced within their housings 231. When the valve 238 is in its open position, hydraulic fluid within the closed loop can flow, and therefore the piston rods 232 can slide within their housings 231.

In use, a golfer steps onto the floor of the deck portion of the platform. If the golfer wants to change the angle or orientation of the incline of the deck, he positions himself on that part of the floor that he wants to move downwardly. He then pushes on the button of the valve to open it. When the valve is opened, hydraulic fluid is permitted to flow through the closed loops and the deck moves under the weight of the golfer. When the button is released, the spring will bias the valve to the closed position and stop the flow of hydraulic fluid.

It will of course be appreciated that numerous alternatives and other embodiments are possible within the broad scope of the invention. For example, while the embodiments described above and shown in the drawings have manual valves with switches located on the side or top of the deck, an alternative would be to have a remote control device for opening and closing the valves which the golfer could access without having to bend down or use his golf club head.

One multiple circuit valve can be used to actuate all of the cylinders of the platform or, where there are more than two cylinders, more than one multiple circuit valve can be used.

It is useful to have all of the cylinders of the platform controlled by the same multiple circuit valve to simplify operation of the deck and to avoid jerking movement of the deck which may occur by opening of circuits at separate times.

While the ports have been shown positioned in a single plane for simplicity, the ports can be in any orientation. For example, the corresponding ports of a pair can be in a single plane, but adjacent pairs can be offset 90°.

While a valve is shown which is useful for controlling two circuits, the valve can be modified to control any number of circuits by adding further pairs of ports. While the rod has been shown having grooves formed therein, it is to be understood that the rod could be adapted in other ways, such as by forming a channel therethrough, for opening or closing the circuit between the ports.

In the embodiments described above and shown in the drawings the hydraulic cylinders are mounted to the deck near the center of the floor. In an alternative embodiment, the hydraulic cylinders could be mounted to the deck near the sides, and thus, be in a substantially upstanding orientation rather than an inclined orientation. However, having the cylinders in an inclined orientation reduces the total height of the platform.

Two hydraulic cylinders are used in the embodiment described above and shown in the drawings to control adjustment of the inclination of the deck in all directions. In alternative embodiments three or more hydraulic cylinders could be employed.

Alternatively, if adjustment of the inclination of the deck is desired in a single direction only, for example, for practising of straight uphill and downhill lies, the deck could be mounted to the base with a hinging assembly, rather than a universal joint assembly, and in such a case a single hydraulic cylinder would be sufficient to control inclination of the deck in the direction of pivoting permitted by the hinging assembly. In yet another modification, such a mounting could be used with a single hydraulic cylinder to provide different inclinations of the practice platform in all directions by incorporating a turn-table mechanism as part of the base.

One or more hydraulic cylinders are a feature of preferred embodiments of the present invention. However, other means for releasably locking the deck in a desired inclination and means for restricting the speed of movement of the deck under a golfer's weight when released may be substituted. For example, pneumatic cylinders could be used rather than hydraulic cylinders. Moreover, mechanical devices, such as ratchet and pawl mechanisms and so forth could be used with appropriate modifications; mechanisms that permit releasable holding in one direction only could be used in pairs, on opposing sides of the mounting assembly, to provide releasable holding of the deck in either direction.

Other materials of construction may also be substituted. For example, high strength plastic could be used for components of the base and deck.

Thus, in its broadest scope, the present invention provides many modifications and alternative embodiments, appropriate for different circumstances.

I claim:

1. A practice platform for use by a golfer to practice swinging a club on different inclines, comprising:

a base;

a deck, pivotally mounted to said base; and hydraulic means for releasably holding said deck at different inclines, including at least two hydraulic cylinders between said deck and said base, and at least one valve means for controlling the flow of hydraulic fluid through said hydraulic cylinders;

said deck being pivotable to different inclines with said valve means in an open position solely by the golfer's positioning himself thereupon so that his weight causes said deck to pivot without the use of power drive means, and said deck being prevented from pivoting when said valve means is in a closed position regardless of where the golfer positions himself thereupon;

wherein at least one of the valve means is adapted to control simultaneously more than one attached hydraulic cylinder.

2. The practice platform of claim 1 wherein the valve means has ports for fluid communication with the attached hydraulic cylinders and means for controlling simultaneously communication between the ports.

3. The practice platform of claim 2 wherein each hydraulic cylinder comprises at least one hydraulic chamber and the valve comprises a housing having a bore therethrough, the housing having formed therethrough at least two pairs of ports opening into the bore for fluid communication between at least two pairs of the chambers; and a rod disposed slidingly in the bore, the rod being adapted to provide for an open circuit or a closed circuit between each pair of ports by sliding movement within the bore.

4. The practice platform of claim 3 wherein each hydraulic cylinder comprises at least one hydraulic chamber and the valve means provides a circuit between each of at least two pairs of the hydraulic chambers.

5. The practice platform of claim 4, wherein said deck is mounted to said base by universal joint means allowing multi-directional pivoting of said deck relative to said base.

6. The practice platform of claim 5 wherein said hydraulic cylinder has a housing connected to one of said base and said deck and has a piston rod connected to the other of said base and said deck, said piston rod including a piston dividing said cylinder into upper and lower hydraulic chambers, and said hydraulic cylinder has fluid lines communicating in a closed loop extending from said upper and lower hydraulic chambers.

7. The practice platform of claim 6 wherein the flow of fluid through said closed loop and said hydraulic cylinder is restricted, thereby moderating the speed at which said deck is pivotable on said base in reaction to the golfer's weight upon said deck.

8. The practice platform of claim 7, having four hydraulic cylinders situated for controlling pivoting of the deck on the base in generally orthogonal directions of inclination.

* * * * *